United States Patent [19]

Smith

[11] Patent Number: 4,964,469

[45] Date of Patent: Oct. 23, 1990

[54] DEVICE FOR BROADCASTING DRY MATERIAL BY EXPLOSIVE FORCE

[76] Inventor: Wayne D. Smith, 6017 122nd SW., Tacoma, Wash. 98063

[21] Appl. No.: 483,319

[22] Filed: Feb. 21, 1990

Related U.S. Application Data

[63] Continuation of Ser. No. 195,213, May 18, 1988, abandoned.

[51] Int. Cl.[5] ..... A62C 19/00; A62C 3/02; A62C 35/08

[52] U.S. Cl. ..... 169/28; 169/36; 169/53; 102/488

[58] Field of Search ..... 169/36, 53, 58, 28, 169/34, 70, 47, 52, DIG. 3; 102/272, 274, 275, 487, 488; 206/508

[56] References Cited

U.S. PATENT DOCUMENTS

| | | | |
|---|---|---|---|
| 228,621 | 6/1880 | Folsom . | |
| 310,888 | 1/1885 | Giblin | 169/36 X |
| 318,761 | 5/1885 | Letson et al. . | |
| 336,981 | 3/1886 | Bartlett | 169/36 |
| 338,604 | 3/1886 | Luyster | 169/36 |
| 648,371 | 5/1900 | Allen . | |
| 798,623 | 9/1905 | Poole et al. | 169/36 |
| 1,187,981 | 6/1916 | Doucette . | |
| 1,223,598 | 4/1917 | Mills | 102/487 X |
| 1,369,476 | 2/1921 | Semple | 102/272 |
| 1,396,894 | 11/1921 | Stevens . | |
| 1,903,348 | 4/1933 | Anderson | 169/36 X |
| 2,073,416 | 3/1937 | Finzi | 169/28 |
| 2,074,648 | 3/1937 | Haimann | 169/28 |
| 2,091,589 | 8/1937 | Finzi | 169/28 |
| 2,306,321 | 12/1942 | Roberts | 244/136 |
| 2,349,980 | 5/1944 | Moore | 102/2 |
| 2,483,310 | 9/1949 | Baker et al. | 169/36 |
| 2,702,599 | 2/1955 | Sights | 169/28 |
| 2,837,998 | 6/1958 | Eggman | 102/488 X |
| 2,873,806 | 2/1959 | Bittner | 169/36 |
| 2,954,948 | 10/1960 | Johnson | 244/136 |
| 3,547,000 | 12/1970 | Haberkorn et al. | 244/136 |
| 3,833,063 | 9/1974 | Williams | 169/28 |
| 3,833,064 | 9/1974 | Ranney, Jr. | 169/36 X |
| 4,285,403 | 8/1981 | Poland | 169/28 |
| 4,304,517 | 12/1981 | Ulin | 414/412 |
| 4,344,489 | 8/1982 | Bonaparte | 169/70 |
| 4,420,093 | 12/1983 | Von Holdt | 206/508 X |
| 4,881,601 | 11/1989 | Smith | 169/53 |

FOREIGN PATENT DOCUMENTS

| | | | |
|---|---|---|---|
| 1311601 | 10/1962 | France | 169/36 |
| 1473621 | 3/1967 | France | 169/28 |
| 2600620 | 12/1987 | France | 169/53 |
| 44488 | 8/1918 | Sweden | 102/487 |
| 449072 | 6/1936 | United Kingdom | 169/36 |
| 532815 | 1/1941 | United Kingdom | 169/36 |

OTHER PUBLICATIONS

"High Altitude Retardant Drop Mechanization Study, Final Report-Vol. I," Northern Forest Fire Laboratory, Missoula, Montana, Apr. 30, 1973 Government and Aeronautical Products Div., Hopkins, MN 55343.

*Primary Examiner*—Joseph F. Peters, Jr.
*Assistant Examiner*—James M. Kannofsky
*Attorney, Agent, or Firm*—Glenn D. Bellamy

[57] ABSTRACT

Disclosed is a device which, upon impact, will broadcast a dry material such as fire-suppressing chemicals by explosive force. The device comprises an explosive charge within a frangible rigid-wall container, a dry powder payload within the container which substantially surrounds the explosive charge, and a fuse cord operably positioned between the explosive charge and an impact-activated detonator. Upon impact, the detonator will cause the fuse to be ignited. Ignition of the fuse cord, whether by the impact-activated detonator or an external source, will cause detonation of the explosive charge, thereby breaking the container and broadcasting the dry material outwardly therefrom.

32 Claims, 5 Drawing Sheets

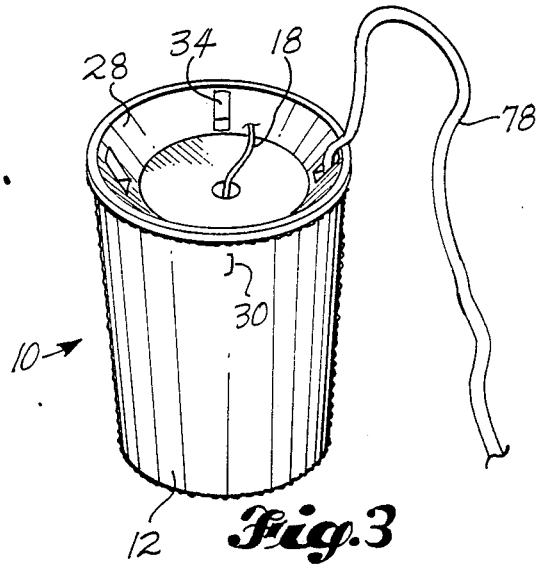
Fig.3
Fig.2
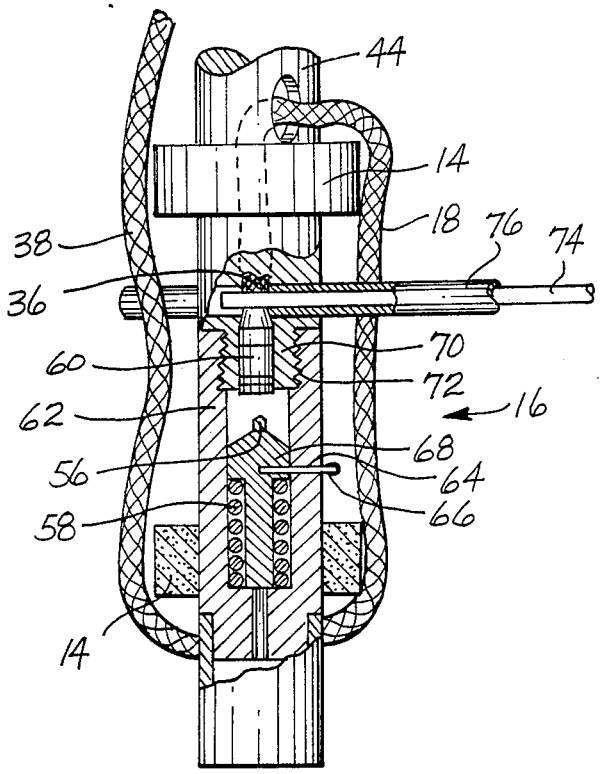

DEVICE FOR BROADCASTING DRY MATERIAL BY EXPLOSIVE FORCE

DESCRIPTION

This application is a continuation of application Ser. No. 195,213, filed May 18, 1988, now abandoned.

1. Technical Field

This invention relates to a device for broadcasting powdered material and, in particular, to a device which by explosive force distributes a fire-suppressing dry chemical for the purpose of extinguishing or controlling forest fires.

2. Background Art

It is well-known in the art to use an explosive charge to distribute fire control material. Such devices typically include a vessel containing liquid or powder fire control material and an explosive charge centered therein, ignitable by a fuse cord which extends from the explosive charge outwardly of the vessel. The fuse cord may be ignited prior to placing the device in the midst of a fire, such as is shown in U.S. Pat. No. 2,873,806, granted to F. Bittner, Feb. 17, 1959; or the device may have a fuse ignitable by presence of the very fire which it is intended to extinguish, such as those shown in U.S. Pat. No. 310,888, issued to J. M. Giblin, Jan. 20, 1885; and U.S. Pat. No. 3,833,063, issued to R. Williams, Sept. 3, 1974.

It is also known in the art to drop such devices designed to explode on impact into a fire area. Devices of this type are disclosed in U.S. Pat. No. 1,903,348, issued to G. C. Anderson, Apr. 4, 1933; U.S. Pat. No. 2,349,980, issued to L. W. Moore, May 30, 1944; and U.S. Pat. No. 4,285,403, issued to C. M. Poland, Aug. 25, 1981.

Still other aerial-deployed devices for distributing fire control material are disclosed in U.S. Pat. No. 2,306,321, issued to R. N. Roberts, Dec. 22, 1942; U.S. Pat. No. 4,344,489, issued to A. Bonaparte, Aug. 17, 1982and "High Altitude Retardant Dropped Mechanization Study," published Apr. 30, 1973, by Northern Forest Fire Laboratory, Missoula, Mont.

Many limitations inherent in the above-identified devices have prevented them from becoming commercially useful in fighting large fires. These devices require sophisticated delivery containers and are capable of carrying only a small volume of fire control material. The high cost associated with these containers make distribution of a large amount of material cost-prohibitive. Furthermore, each of the above-referenced devices uses a single mode of detonation or delivery: i.e., aerial scatter, impact activation, or externally ignitable fuse.

An object of the present invention is to provide a container which is simple and inexpensive enough to allow cost-effective delivery of large volumes of fire control material. By providing a container which is completely biodegradable, the amount of residual debris is greatly reduced.

It is a further object of this invention to provide a versatile device for explosively broadcasting dry chemical fire control material or other dry material. The device of the present invention may be impact-activated upon contact with the ground, may be passively detonated by ignition of a fuse by the fire to be controlled, or actively detonated by ignition of a fuse from a variety of remotely-operated modalities.

DESCRIPTION OF THE INVENTION

Disclosed is a device for broadcasting a fire-suppressing dry chemical material. This device includes a frangible rigid-wall container having an explosive charge located therein. A fire-suppressing dry chemical powder substantially surrounds the explosive charge and substantially fills the container. An impact-activated detonator is used to ignite a fuse cord operably positioned between the detonator and the explosive charge.

The container may be constructed in two parts such that a lower portion may be filled with the chemical powder and the explosive charge and then have a lid portion attached thereto. The container may be constructed of a biodegradable material such as a compressed composite fibrous vegetable matter made of paperboard, peat moss, or the like. Such material is lightweight, inexpensive to produce, durable for handling and readily frangible by the explosive charge. Because the material is biodegradable, the amount of residual debris from the device is significantly reduced. According to another aspect of the invention, a pesticide may be included in the container material as a means of controlling predatory insects which can damage trees which survive a fire.

The container may be formed to have tapered sidewalls which converge toward the bottom and the lid portion may be sized to fit downwardly between the sidewalls of the lower portion of the container, thereby forming a recess which may receive a bottom portion of another container. A plurality of containers having this similar construction are readily stackable. By concentrating the contents of the container into a lower portion, the center of gravity of the device is located at a point below the vertical center of the container. Alternatively, an aerodynamic drag-producing member, such as a streamer or the like, may be attached to an upper portion of the container. A lowered center of gravity or a slight amount of drag added to an upper portion of the container will cause the device to fall in an upright orientation when dropped from the air.

Another aspect of the invention is that the fuse cord may be extended at one end outwardly through the container wall such that one end of the fuse cord is operably adjacent the impact-activated detonator, the other end extends to the outside of the container, and a central portion is operably adjacent the explosive charge. In this manner, ignition of the fuse cord at either end will cause detonation of the explosive charge.

The fuse cord may be extended outwardly some distance from the container such that presence of flames in the vicinity of the device will ignite the fuse and cause the device to be detonated. The device may also be operated remotely by attachment of a radio-controlled igniter to the fuse cord. Additionally, an igniter may be attached to the fuse cord which is activated by physical displacement, such as when the device is released to drop from an airplane or helicopter.

According to another aspect of the invention, the device may be fitted with an internal tube member extending from a wall of the container inwardly to a central location of the container. This tube member may be used to house the impact-activated detonator. Also, according to an aspect of the invention, the explosive charge may be situated around a portion of the tube.

In preferred form, the tube may be used to house a fuse cord extending from either the internal detonator or from a location exterior of the container, to the explosive charge within the container.

Also in preferred form, the detonator may include a removable detonation safety member. When situated between the detonator and the fuse cord, an unintentional activation of the internal detonator is physically blocked from causing ignition of the fuse cord. In an alternative arrangement, the safety member may retain a detonation cartridge away from activating contact with a firing pin. The safety member may extend from its operable position outwardly through a sidewall of the container such that the safety member may be removed or inserted without the necessity of opening the container.

BRIEF DESCRIPTION OF THE DRAWINGS

Referring to the several drawing figures, wherein like numerals refer to like parts throughout, and wherein:

FIG. 2 is a fragmentary, partially cut-away view of the impact-activated detonator, such view also showing placement of the explosive charge, fuse cord, and safety member;

FIG. 3 is a pictorial view of a preferred embodiment of the invention showing an attached streamer.

BEST MODE FOR CARRYING OUT THE INVENTION

Figure 1:
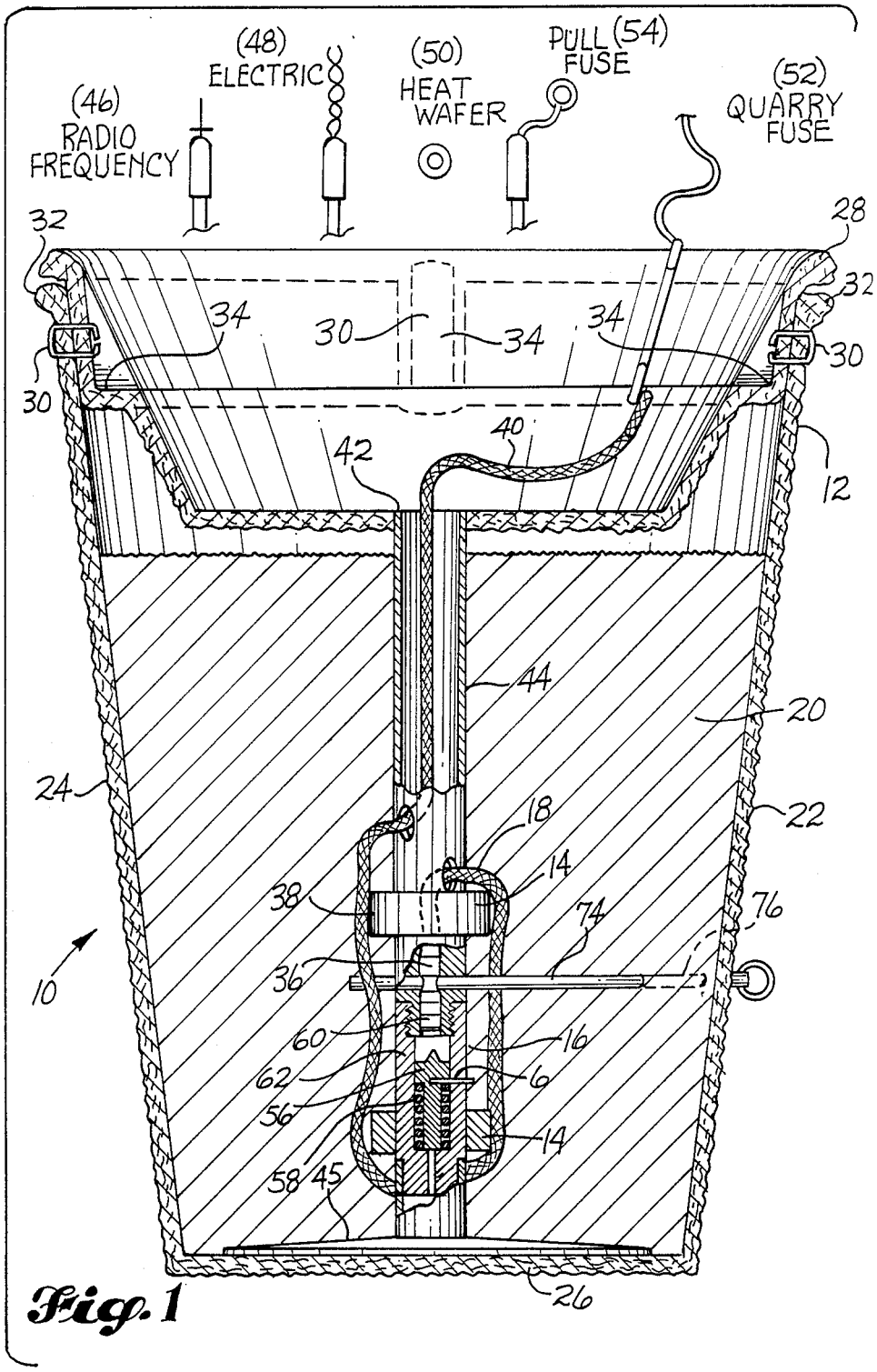
FIG. 1 is a cross-sectional view of a device embodying features of the present invention, such view showing alternate fuse igniters.

Referring again to the figures of the drawing, and first to FIG. 1, the illustrated embodiment of the device 10 comprises a frangible rigid-wall container 12, an explosive charge 14, an impact-activated detonator 16, a fuse cord 18, and a fire-suppressing dry chemical powder material 20 within the container 12 which substantially surrounds the explosive charge 14.

The container 12 may be formed in two parts. A lower portion consists of sidewalls 22, 24 and a bottom panel 26. A lid portion 28, made of the same material as the lower portion, is used to close the container 12 preventing spillage of the dry chemical material 20. The lid portion 28 may be secured to the sidewalls 22, 24 by adhesive or staples 30. In preferred form, the container 12 is fabricated of a compressed composite fibrous vegetable matter, such as paperboard, peat moss, or the like. This type of material is inexpensive to produce, is lightweight and is readily frangible by the explosive charge 14 in all directions.

Additionally, such a fiber composition container 12 may simultaneously act as a vehicle for the distribution of a pesticide. Because predatory insects can inflict severe damage upon trees which survive a fire, it is desirable to distribute insect control agents along with the fire-suppressing material. Examples of such predatory insects are: Spruce Budworm (*Choristoneura Fumiferana*); Western Spruce Budworm (*Choristoneura Occidentalis*); and Mountain Pine Beetle (*Dendroctonus Ponderosae*). Often, the most destructive predatory insects are those which burrow in the bark of trees. By impregnating the fibrous containers with an appropriate insecticide and attracting hormone, such borrowing insects will be attracted to and consume fragments of the exploded container, thereby being killed or sterilized before having an opportunity to attack trees. The pesticide of choice may have broad-based efficacy, or may be targeted. An example of a broad-based pesticide is Carbaryl, commonly sold under the trade name SEVIN. An example of a targeted biological pesticide is *Bacillus Thuringiensis* (Bt). Bt is effective almost solely against the Spruce Budworm, although less effective than other broad-based pesticides.

In preferred form, the lower portion of the container 12 may be substantially frustoconical in shape, thereby being substantially circular at its upper edge 32 having convergingly tapered sidewalls 22, 24 and a substantially flattened circular bottom panel 26. The lid portion 28 may be constructed to form a recess at the top of the container 12. In this manner, the lower end of a frustoconically-shaped container 12 will seat within the recess formed by the lid portion 28 of another container 12, thereby being readily stackable and resistant to lateral displacement. A plurality of detents may be formed in the lid portion 28 so as to provide an increased area of surface contact between the lid portion 28 and the lower portion of the container 12. The detent areas 34 may be the location for fastener staples 30 or fastening adhesive.

According to another aspect of the invention, the fuse cord 18 may have a first end 36 adjacent to the detonator 16, a central portion 38 adjacent the explosive charge 14, and a second end 40 which extends outwardly through a wall of the container 12. In the illustrated embodiment of FIG. 1, the second end of the fuse cord 40 extends upwardly through an opening 42 formed in the lid portion 28 of the container 12. Also shown in this embodiment is a tube member 44 which extends from a wall of the container 12 inwardly to the central location of the detonator 16. This tube member 44 serves, among other functions, to provide a passageway for the fuse cord 18, shielding it, at least in part, from the fire-suppressing dry chemical powder 20 which substantially fills the container 12. Rigidly attached to the bottom end of the tube 44 is a radially outwardly extending base plate member 45. One function of the base plate 45 is to concentrate the impact of the device 10 hitting the ground directly to the tube member 44 which houses the impact-activated detonator 16. Another purpose of the base plate 45 is to outwardly deflect the explosive force of the explosive charge 14. In preferred form, the explosive charge 14 is shaped in one or more relatively narrow rings extending around the tube 44. This construction, in combination with the base plate 45, causes the dry material 20 to be broadcast generally lateral direction, rather than upward or downward.

Any of a variety of igniters may be attached to the second end of the fuse cord. Such igniters may include those remotely activated by a radio frequency 46 or an electrical current 48. Other igniters may include those activated by heat 50 or by presence of flames in the vicinity of the device, such as by using a quarry fuse 52 extended outwardly some distance from the device 10. A pull fuse 54 is activated by physical displacement. A pull fuse igniter 54 may be used to activate a device 10 on the ground by retracting a line which has been attached to the pull fuse igniter 54 from a remote position, may be activated by the movement of the device 10, such as the device 10 being dropped from an aircraft. In such a situation, the device 10 could be activated at the time of aerial release to provide detonation prior to impact with the ground.

Within container 12 is an impact-activated detonator 16 (see FIG. 1). This embodiment of the detonator 16 includes a firing pin 56 biased by a spring 58 into activating contact with a detonation cap 60. Shown in FIG. 2 is a preferred embodiment of this impact-activated detonator 16.

In this embodiment, the firing pin 56 is slidable within a casing 62. The firing pin 56 is retained from contact with the detonation cap 60 by a shear pin 64. In this embodiment, the shear pin 64 is inserted through an opening 66 formed in a sidewall of the detonator casing 62 and into a corresponding opening 68 formed in the firing pin member 56, thereby maintaining the spring 58 in compression. Impact of the device 10 with the ground is sufficient to cause the force of the spring 58 to overcome the strength of the shear pin 64, thereby shearing the pin 64 and allowing the firing pin 56 to advance into activating contact with the detonation cap 60.

The detonation cap or cartridge 60 is operably mounted within a second casing 70. In preferred form, the second casing 70 may be operably joined with the firing pin casing 62 by engageable threads 72. In such an embodiment, the components within the casing 62, 70 may be assembled separately and then joined together at the threaded joint 72.

The first end 36 of the fuse cord 18 is operably positioned to be ignited by the detonator cap 60 when the detonator cap 60 is activated by the firing pin 56.

Between the detonation cap 60 and the first end 36 of the fuse cord 18 may be positioned a removable detonation safety member 74. When in place, the safety member 74 physically blocks ignition of the first end 36 of the fuse cord 18. In this manner, accidental activation of the detonation cap 60, when the safety member 74 is in place, will not cause ignition of the first end 36 of the fuse cord 18. The safety member 74 may be slidably situated within a conduit 76 which interconnects the detonation casing 70 with the exterior of the container 12. The safety member 74 may be long enough to extend outward of the container 12 such that the safety member 74 may be removed or inserted without the necessity of opening the container 12. The device 10 need not be armed by removal of the safety member 74 until immediately prior to use.

Figure 4:
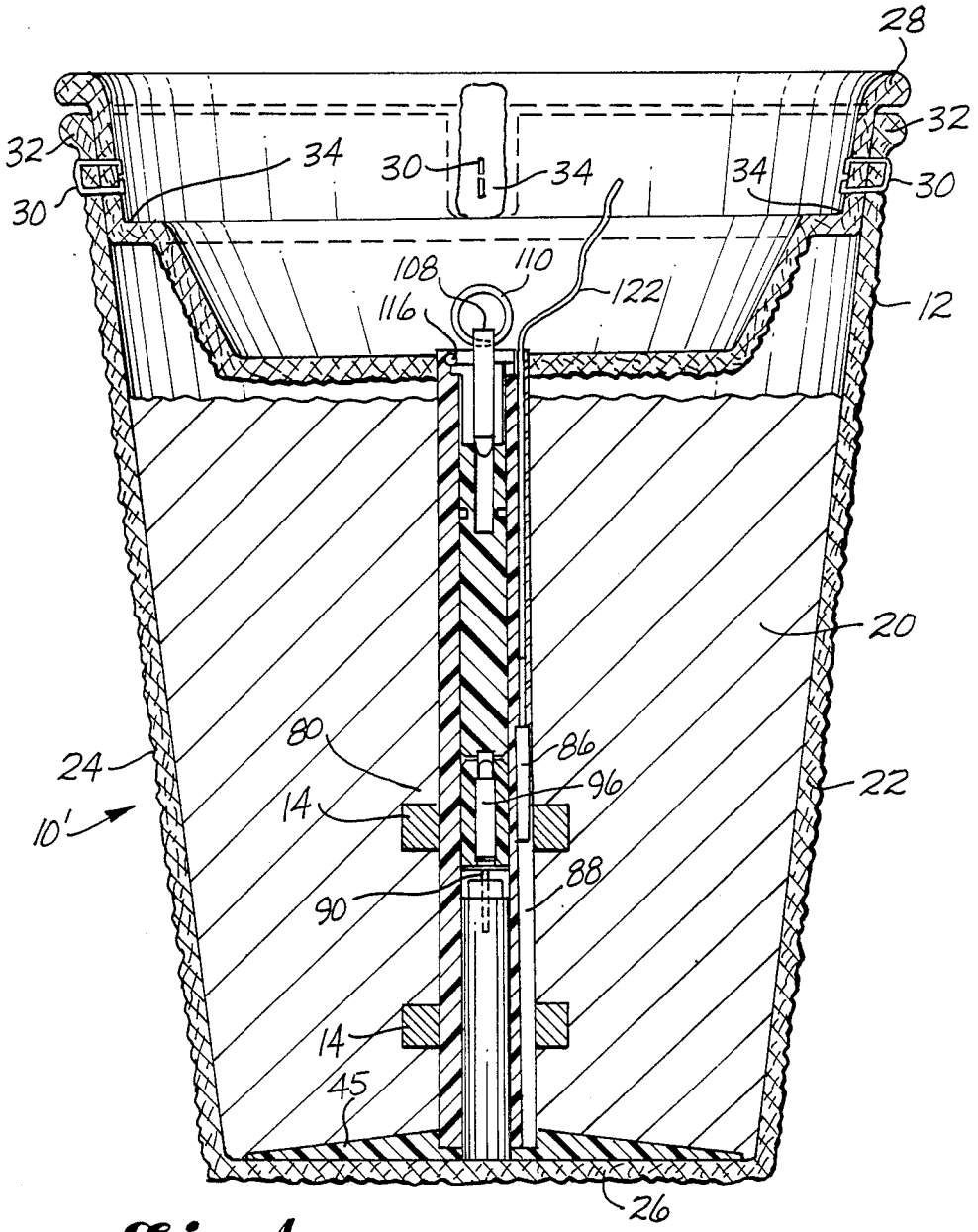
FIG. 4 is a cross-sectional view of an alternative embodiment of the present invention.

Shown in FIG. 4 is an alternative embodiment of the device 10' including an impact-activated detonator 80. The detonator 80 is generally centrally located within the container 12 and, along with the explosive charge 14, is substantially surrounded by the dry powder payload 20.

Figure 5:
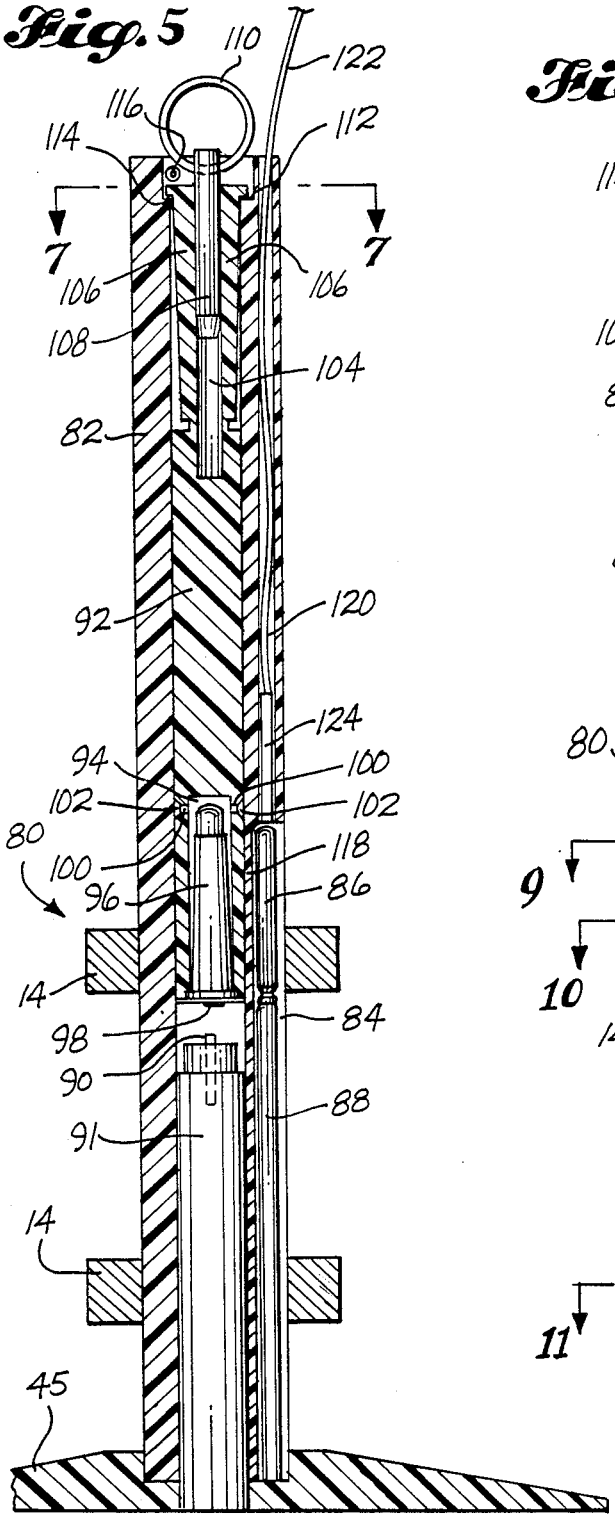
FIG. 5 is a cross-sectional view of an alternative impact-activated detonator with the safety member in place.
Figure 6:
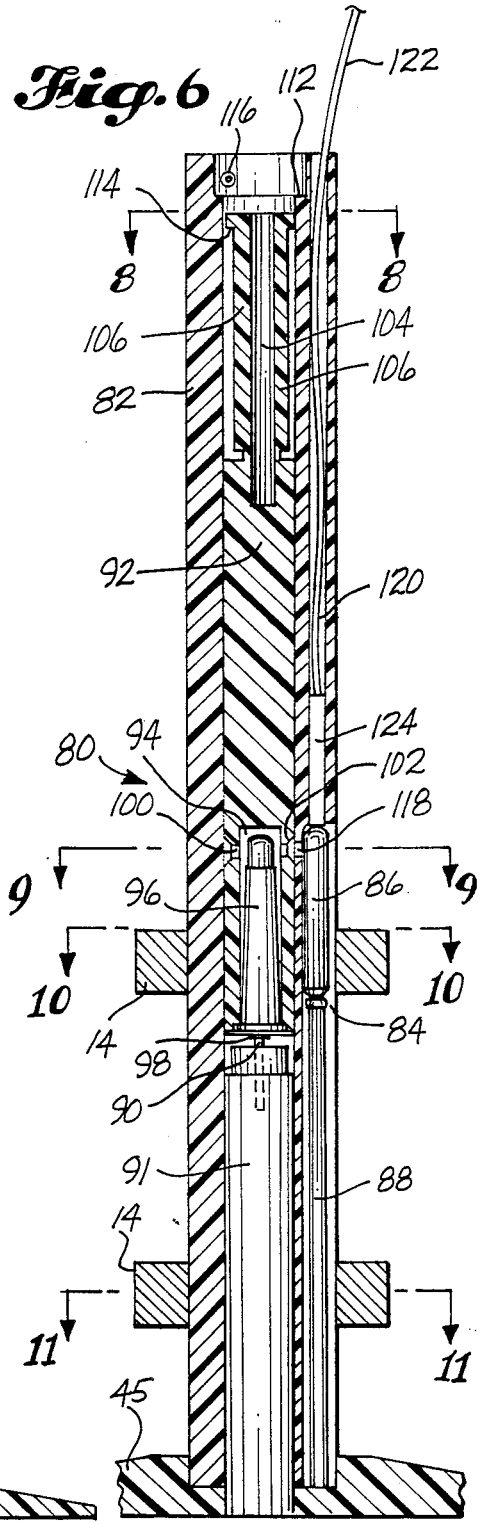
FIG. 6 is a cross-sectional view similar to FIG. 5 except that the safety member has been removed.
Figure 7:
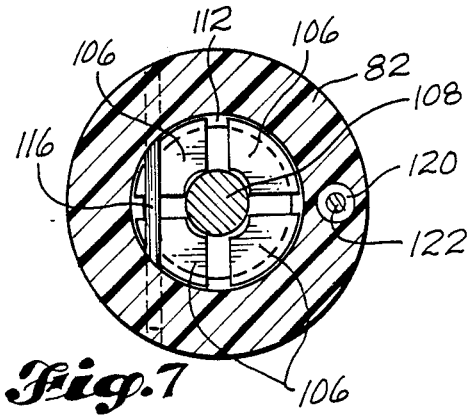
FIG. 7 is a sectional view taken substantially along line 7—7 of FIG. 5.
Figure 8:
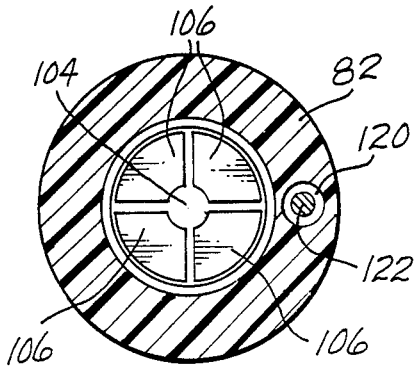
FIG. 8 is a sectional view taken substantially along line 8—8 of FIG. 6.
Figure 9:
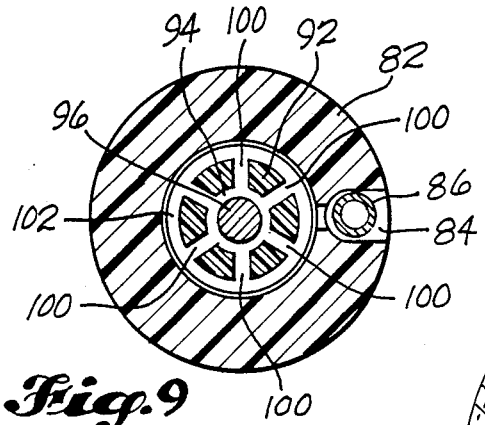
FIG. 9 is a sectional view taken substantially along line 9—9 of FIG. 6.
Figure 11:
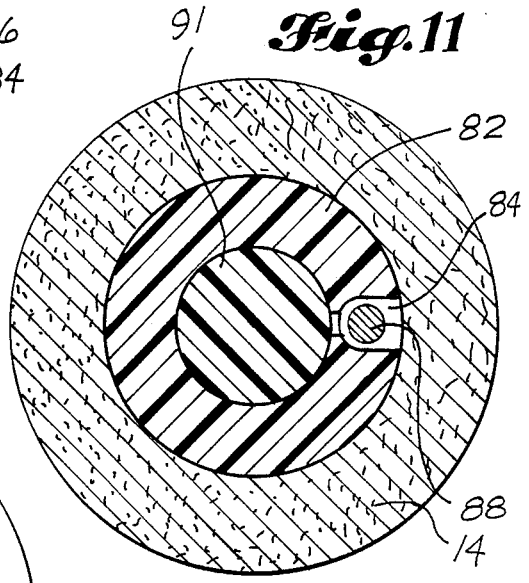
FIG. 11 is a sectional view taken substantially along line 11—11 of FIG. 6.
Figure 10:
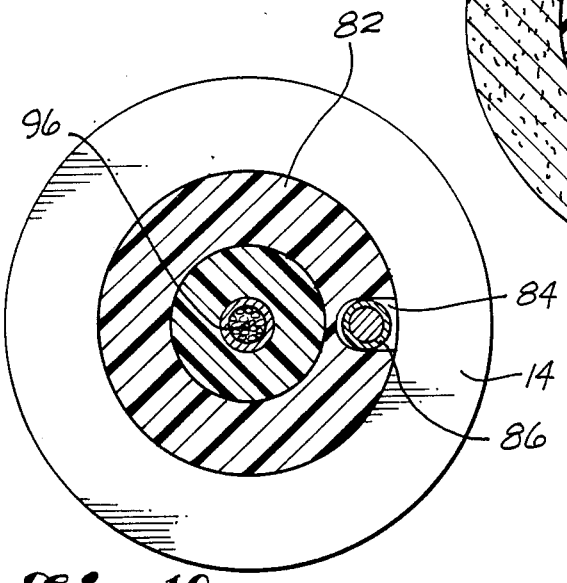
FIG. 10 is a sectional view taken substantially along line 10—10 of FIG. 6.

Referring now to FIGS. 5 and 6, therein is shown the detonator 80 which includes an elongated tube member 82, having rigidly attached to its bottom end a base plate member 45. An elongated groove 84 is formed longitudinally along part of a sidewall of the tube member 82. Within the groove 84 is located a fuse igniter 86 and a prima cord fuse 88 which are operably adjacent the explosive charges 14. A firing pin 90 is located at approximately the diametric center of the tube member 82 supported by a bottom plug member 91. Slidably situated within the tube member 82 is an elongated body member 92. At the lower end of the body member 92 is a firing chamber 94 within which is located a detonation cartridge 96. This detonation cartridge 96 may be, for example, a .38 caliber cartridge. The cartridge 96 has a primer 98 operably positioned to contact the firing pin 90. Adjacent the upward end of the chamber 94 are outwardly directed ports 100 which pass radially outwardly from the chamber 94 through sidewalls of the body 92. An annular groove 102 is formed around the outside of body member 92 at the location of the ports 100.

A longitudinal central opening 104 is formed in the upper end of the body member 92. Sidewalls of the body member 92 are longitudinally split into two or more sections 106 adjacent the opening 104. The embodiment illustrated in FIGS. 5 through 8 includes four sections 106. A safety pin member 108, which may include a pull ring 110, is provided having a diameter too large to be received within the opening 104 unless the sections 106 are outwardly deflected. The sections 106 are preferably made of a resilient material so that they may be easily deflected to allow insertion of the safety pin 108 into the opening 104, and then return to a normal position upon removal of the safety pin 108. At the upper end of tube member 82 is an inner annular notch 112. With the sections 106 in their normal positions, the body member 92 is longitudinally slidable within tube member 82. However, when the safety pin 108 is in place within the opening 104 and the sections 106 are outwardly deflected, a lip portion 114 on each section 106 may engage with the annular notch 112, thereby preventing body member 92 from sliding downward within the tube member 82. In this manner, the primer 98 of the cartridge 96 is held in a spaced position from the firing pin 90. This configuration is shown in FIG. 5. When the safety pin 108 is removed, as shown in FIG. 6, body member 92 is allowed to slide downwardly within the tube member 82 and the primer 98 of the cartridge 96 is operably adjacent the firing pin 90. A retaining pin 116 keeps the body member 92 from being upwardly removed from tube member 82. The retention pin 116 may be removed by sliding through holes formed in sidewalls of tube member 82 to allow removal of body member 92, thereby completely disarming the impact-activated detonator 80.

A sidewall opening 118 is provided in a sidewall of tube member 82. The sidewall opening 118 is positioned to be substantially aligned with the annular groove 102 and to provide a detonation conduit between firing chamber 94 and prima cord igniter 86 only when the cartridge is in its armed position against the firing pin.

A longitudinal passageway 120 may extend through a sidewall of tube member 82 from its upper end to the groove 84. This passageway 120 provides access for an alternate external ignition means. The external ignition means may include a fuse 122 and a detonator 124 operably positioned to detonate prima cord igniter 86 and, in turn, the explosive charge 14. The fuse 122 may extend outwardly some distance from the top of the tube member 82 and may be ignited by any of the previously-described ignition means.

According to a preferred use of the device 10', it may be dropped from an aircraft to broadcast a payload of fire-suppressing dry chemical powder into a forest fire. A pull igniter may be attached to the outward end of the fuse 122. The pull igniter 54 and the safety pin ring 110 may be tethered to a fixed point on the aircraft such that when the device 10' is dropped therefrom, the fuse 122 is ignited and the impact-activated detonator 80 is armed.

Also according to a preferred use, the device is dropped from the air such that it will explode at a point approximately half-way between treetops and the ground. It is well known in the art to use detonation fuses having known burning times, e.g. four seconds per foot. By dropping the device 10' from a known distance above the ground and/or treetops, and by using a fuse 122 having an appropriate burning time, the device 10' may be detonated to explode with reasonable accuracy at any desired distance above the ground. By having the impact-activated detonator 80 armed during any such drop, any device 10' which fails to detonate in mid-air will explode upon contact with the ground. This backup detonation means reduces waste of the fire-suppressing chemical payload and eliminates the danger of active unexploded devices 10' being left on the ground.

Shown in FIG. 3 is an aerodynamic drag-producing streamer 78 attached to an upper portion of the container 12. The drag-producing effect of the streamer 78 separately, or in conjunction with the device 10 having a center of gravity lower than the vertical center, causes the device 10, when dropped from the air, to fall in an upright orientation. By having a controlled orientation of the device 10 at impact with the ground, the impact-activated detonator 16 may be oriented accordingly within the container 12 to provide consistent activation of the detonator 16 upon impact with the ground.

The invention and its inherent advantages will be understood from the foregoing description of a typical and preferred embodiment, constituting the best mode of the invention known to the applicant at the time of filing the patent application. However, it will be apparent from the embodiment, and from the following claims, that various changes may be made in form, construction, and arrangement of the parts of the device without departing from the spirit and scope of the invention. Accordingly, I do not wish to be restricted to the specific form shown, or to the specific use mentioned, except to the extent that the invention is defined in the following claims.

What is claimed is:

1. A dry material broadcast device, comprising:

a frangible rigid-wall container;

an explosive charge within said container;

a removable impact-activated detonator including an explosive portion;

a fuse cord operably positioned between said explosive portion of said detonator and said explosive charge; and dry payload material within said container and substantially surrounding said explosive charge, said detonator in operation being located within said container and said explosive portion of said detonator being readily removable from said container without substantial disassembly of said container to thereby disarm said device by physical separation of the explosive portion and said explosive charge.

2. The device of claim 1, wherein said container is comprised of a lid portion and a lower portion, said lower portion having sidewalls and a bottom.

3. The device of claim 2, wherein said container is made of a biodegradable material.

4. The device of claim 1, wherein said container is made of a biodegradable material.

5. The device of claim 1, wherein said fuse cord has two ends and a central portion therebetween, the first end being adjacent said detonator and the central portion being in immediate proximity to said explosive charge.

6. The device of claim 5, wherein said second end of said fuse cord is operably connected to a detonation means.

7. The device of claim 6, further comprising a second fuse cord attached to said detonation means, said second fuse extending outwardly through a wall of said container a distance from the container such that a fire in the vicinity of said container may ignite said second fuse.

8. The device of claim 6, further comprising said detonation means being attached to said second end of the fuse cord, said detonation means being activated by a radio frequency.

9. The device of claim 6, further comprising said detonation means being attached to said second end of said fuse cord, said detonation means being activated by physical movement of a pull cord.

10. The device of claim 6, further comprising said detonation means being attached to said second end of said fuse cord, said detonation means being activated by being heated to a preselected temperature.

11. The device of claim 1, wherein said explosive portion of said detonator is located within a tube member, said tube member having top and bottom ends and extending substantially vertically between walls of said container and further including a substantially perpendicular radially outwardly extending base plate member rigidly attached to the bottom end of said tube member, said detonator being removable through an end of said tube member, and said base plate and said tube member communicating impact shock to said impact-activated detonator.

12. The device of claim 11, wherein said explosive charge is situated externally of said tube member.

13. The device of claim 12, wherein said fuse extends from the detonator within said tube member to a point outside said tube adjacent said explosive charge.

14. The device of claim 13, wherein said fuse has two ends and a central portion therebetween, the first end being adjacent said detonator and the central portion being in immediate proximity to said explosive charge.

15. The device of claim 14, wherein the second end of said fuse extends to a position adjacent a second detonator.

16. The device of claim 12, further comprising a removable detonation safety member situated between said detonator and said fuse.

17. The device of claim 12, wherein said detonator includes a cartridge within a firing chamber, said firing chamber having at least an outwardly directed opening, and said firing chamber and said cartridge being longitudinally slidably mounted within and removable from said tube member, a firing pin being positioned to provide activating contact with said cartridge, and said fuse being operably adjacent said outwardly directed opening.

18. The device of claim 1, wherein said device has a center of gravity located below the vertical center of the device such that when said device is freely dropped from a distance above the ground, said device will self-orient to a substantially upright position prior to contact with the ground.

19. The device of claim 18, further comprising an aerodynamic drag-producing member attached to an upper portion of the container.

20. A dry material broadcast device, comprising:
a frangible rigid-wall container;
an explosive charge within said container;
an impact-activated detonator;
a fuse cord operably positioned between said detonator and said explosive charge; and
dry payload material within said container and substantially surrounding said explosive charge,
wherein said container is comprised of a lid portion and a lower portion, said lower portion having sidewalls and a bottom,
wherein said container is made of a biodegradable material, and
wherein said biodegradable material includes a pesticide.

21. A dry material broadcast device, comprising:
a frangible rigid-wall container;
an explosive charge within said container;
an impact-activated detonator;
a fuse cord operably positioned between said detonator and said explosive charge; and
dry payload material within said container and substantially surrounding said explosive charge,
wherein said container is comprised of a lid portion and a lower portion, said lower portion having sidewalls and a bottom, and
wherein said lower portion of the container has tapered sidewalls which converge toward the bottom and said lid portion being sized to fit downwardly between the sidewalls of the lower portion of the container, said lid portion being recessed to receive a bottom portion of another container having similar construction.

22. The device of claim 21, wherein said container is made of a biodegradable material.

23. The device of claim 22, wherein said biodegradable material includes a pesticide.

24. A dry material broadcast device, comprising:
a frangible rigid-wall container;
an explosive charge within said container;
an impact-activated detonator;
a fuse cord operably positioned between said detonator and said explosive charge; and
dry payload material within said container and substantially surrounding said explosive charge,
wherein said detonator is at least partially located within a tube member, said tube member extending substantially vertically between walls of said container and including a substantially perpendicular radially outwardly extending base plate member rigidly attached to a bottom end of said tube member, and
wherein said container has a lower portion with tapered sidewalls which converge toward a bottom and a lid portion sized to fit downwardly between the sidewalls of said lower portion of the container, said lid portion being recessed to receive a bottom of another container having similar construction.

25. The device of claim 24, wherein said explosive charge is situated externally of said tube.

26. The device of claim 25, wherein said fuse extends from the detonator within said tube to a point outside said tube adjacent said explosive charge.

27. The device of claim 26, wherein said fuse has two ends and a central portion therebetween, the first end being adjacent said detonator and the central portion being in immediate proximity to said explosive charge.

28. The device of claim 27, wherein the second end of said fuse extends outwardly through a wall of the container.

29. The device of claim 25, wherein said detonator includes a cartridge within a firing chamber, said firing chamber having at least an outwardly directed opening, said firing chamber and said cartridge being longitudinally slidably mounted within said tube, a firing pin positioned to provide activating contact with said cartridge, and said fuse being operably adjacent said outwardly directed opening.

30. A dry material broadcast device, comprising:
a frangible rigid-wall container;
an explosive charge within said container;
an impact-activated detonator;
a fuse cord operably positioned between said detonator and said explosive charge; and
dry payload material within said container and substantially surrounding said explosive charge,
wherein said device has a center of gravity located below the vertical center of the device, and
wherein said container has a lower portion with tapered sidewalls which converge toward a bottom and a lid portion being sized to fit downwardly between the sidewalls of said lower portion of the container, and said lid portion being recessed to receive a bottom of another container having similar construction.

31. The device of claim 30, further comprising an aerodynamic drag-producing member attached to an upper portion of the container.

32. A dry material broadcast device, comprising:
a frangible rigid-wall container;
an explosive charge within said container;
an impact-activated detonator;
a fuse cord operably positioned between said detonator and said explosive charge; and
dry payload material within said container and substantially surrounding said explosive charge,
wherein said container is made of a biodegradable material, and
wherein said biodegradable material includes a pesticide.

* * * * *